US012501994B2

(12) United States Patent
Staudt et al.

(10) Patent No.: US 12,501,994 B2
(45) **Date of Patent: *Dec. 23, 2025**

(54) PERSONAL CARE PRODUCT DISPENSING SYSTEM

(71) Applicant: The Gillette Company LLC, Boston, MA (US)

(72) Inventors: Jonathan William Staudt, Mt. Healthy, OH (US); Jack C. Chang, Mason, OH (US)

(73) Assignee: The Gillette Company LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/946,510

(22) Filed: Nov. 13, 2024

(65) Prior Publication Data

US 2025/0064202 A1 Feb. 27, 2025

Related U.S. Application Data

(63) Continuation of application No. 18/357,317, filed on Jul. 24, 2023, now Pat. No. 12,178,310.

(Continued)

(51) Int. Cl.
*A46B 11/00* (2006.01)
*A45D 34/04* (2006.01)

(Continued)

(52) U.S. Cl.
CPC ..... *A46B 11/0027* (2013.01); *A46B 3/005* (2013.01); *A46B 11/0062* (2013.01);

(Continued)

(58) Field of Classification Search
CPC ..... A45D 34/04; A45D 2200/1009; A45D 40/26; A45D 40/262; A45D 34/042;

(Continued)

(56) References Cited

U.S. PATENT DOCUMENTS 1,054,229 A 2/1913 Methven
1,395,302 A 11/1921 Shalkop (Continued)

FOREIGN PATENT DOCUMENTS

CA 852410 A 9/1970
CA 1288391 C 9/1991

(Continued)

OTHER PUBLICATIONS

U.S. Appl. No. 29/973,194, filed Nov. 14, 2024, Jonathan William Staudt et al.

(Continued)

*Primary Examiner* — David J Walczak
(74) *Attorney, Agent, or Firm* — John M. Lipchitz

(57) ABSTRACT

A personal care product dispensing system with a body defining a cavity configured to retain a spreadable personal care product. A spreadable material is positioned within the cavity. A cover is mounted to the body. The cover defines a first aperture extending from a top surface of the cover to a bottom surface of the cover. A flexible applicator pad is mounted to the top surface of the cover with a valve positioned over the first aperture. The flexible applicator pad has a plurality of projections and each of the projections has a maximum cross sectional area of 0.20 $mm^2$ to 0.60 $mm^2$.

19 Claims, 5 Drawing Sheets

Related U.S. Application Data

(60) Provisional application No. 63/391,462, filed on Jul. 22, 2022.

(51) Int. Cl.
*A45D 40/26* (2006.01)
*A46B 3/00* (2006.01)
*A46B 7/04* (2006.01)
*A46D 1/00* (2006.01)

(52) U.S. Cl.
CPC ..... *A46D 1/02* (2013.01); *A45D 34/042* (2013.01); *A45D 40/262* (2013.01); *A45D 2200/1009* (2013.01); *A46B 7/04* (2013.01); *A46B 7/042* (2013.01); *A46B 2200/1046* (2013.01)

(58) Field of Classification Search
CPC . A46B 3/005; A46B 11/0027; A46B 11/0062; A46B 2200/1046; A46B 11/00; A46B 11/001; A46B 11/002; A46B 7/04; A46B 7/042; A46B 1/02
USPC ..... 401/268, 270, 282, 290, 186
See application file for complete search history.

(56) References Cited

U.S. PATENT DOCUMENTS

| | | | |
|---|---|---|---|
| 1,546,288 | A | 7/1925 | Larsson |
| 1,593,133 | A | 7/1926 | Nichols |
| 1,857,857 | A | 5/1932 | Medley |
| 1,937,006 | A | 11/1933 | Aronson |
| 2,284,207 | A | 5/1942 | Smith |
| 2,588,877 | A | 3/1952 | Reed |
| 2,756,908 | A | 7/1956 | Miller |
| 2,764,772 | A | 10/1956 | Staskowski et al. |
| 2,849,737 | A | 9/1958 | Piccinini et al. |
| 2,897,526 | A | 8/1959 | Dootson |
| 3,093,857 | A | 6/1963 | Hersh |
| 3,164,856 | A | 1/1965 | Samaras et al. |
| 3,209,769 | A | 10/1965 | Gobin |
| 3,228,057 | A | 1/1966 | Parrish |
| 3,231,925 | A | 2/1966 | Conder |
| 3,299,465 | A | 1/1967 | Dykes, Jr. |
| 3,343,201 | A | 9/1967 | Cox et al. |
| 3,346,908 | A | 10/1967 | Johnson |
| 3,351,418 | A | 11/1967 | Karnuth |
| 3,363,968 | A | 1/1968 | Williams |
| 3,370,908 | A | 2/1968 | Cupp |
| 3,376,095 | A | 4/1968 | Johnson |
| 3,378,331 | A | 4/1968 | Beasley |
| 3,387,911 | A | 6/1968 | Focht |
| 3,388,958 | A | 6/1968 | Johnson |
| 3,408,151 | A | 10/1968 | Cleghorn |
| 3,495,922 | A | 2/1970 | Steinman |
| 3,609,050 | A | 9/1971 | Alexander |
| 3,653,090 | A | 4/1972 | Weaver |
| 3,726,009 | A | 4/1973 | Hackmyer |
| 3,804,537 | A | 4/1974 | Pass |
| 3,981,597 | A | 9/1976 | Cohn |
| 4,252,455 | A | 2/1981 | De La Pena |
| 4,481,138 | A | 11/1984 | Tachibana et al. |
| 4,533,273 | A | 8/1985 | Obata et al. |
| 4,603,992 | A | 8/1986 | Kavoussi |
| 4,636,102 | A | 1/1987 | Drake |
| 4,682,713 | A | 7/1987 | Clapp |
| 4,753,547 | A | 6/1988 | Dodero |
| 4,762,433 | A | 8/1988 | Bergeson |
| 4,998,545 | A | 3/1991 | Hiromura |
| 5,186,364 | A | 2/1993 | Laszlo |
| D342,319 | S | 12/1993 | Cheng |
| 5,772,347 | A | 6/1998 | Gueret |
| 6,003,523 | A | 12/1999 | Nettlefold |
| 6,168,335 | B1 | 1/2001 | Mears et al. |
| 6,551,000 | B2 | 4/2003 | Kandasamy |
| D506,027 | S | 6/2005 | Angeletta |
| D654,792 | S | 2/2012 | Bertelsen |
| 8,714,858 | B2 | 5/2014 | Screnci, Jr. et al. |
| 8,794,249 | B2 | 8/2014 | Gerber et al. |
| 8,893,933 | B2 | 11/2014 | Ohshima |
| 9,022,258 | B2 | 5/2015 | Nehren et al. |
| 9,462,873 | B2 | 10/2016 | Casasanta, III |
| 9,474,360 | B2 | 10/2016 | Alsalameh |
| 9,801,448 | B1 | 10/2017 | Jakubow |
| 9,826,823 | B1 | 11/2017 | Velazquez et al. |
| D810,447 | S | 2/2018 | Dandridge |
| 9,914,581 | B2 | 3/2018 | Gutow et al. |
| D820,091 | S | 6/2018 | Phillips |
| D846,408 | S | 4/2019 | Rossetti |
| 10,315,835 | B2 | 6/2019 | Jack et al. |
| 10,598,230 | B2 | 3/2020 | Grez et al. |
| 10,736,395 | B2 | 8/2020 | Kodama et al. |
| 10,799,015 | B1 | 10/2020 | Velazquez et al. |
| 10,925,372 | B2 | 2/2021 | Calhoun |
| 11,213,108 | B2 | 1/2022 | Meranus |
| 11,234,505 | B2 | 2/2022 | Di Mella |
| 11,278,099 | B2 | 3/2022 | Grez et al. |
| 11,291,284 | B2 | 4/2022 | Grez et al. |
| 11,304,490 | B2 | 4/2022 | Screnci et al. |
| 11,324,302 | B1 | 5/2022 | Heilman |
| 11,363,872 | B1 | 6/2022 | Lydiard |
| D979,846 | S | 2/2023 | Gong |
| D984,046 | S | 4/2023 | Sheregar |
| D989,065 | S | 6/2023 | Yi |
| D991,468 | S | 7/2023 | Solana |
| D1,010,324 | S | 1/2024 | Van Roosmalen |
| D1,056,337 | S | 12/2024 | Staudt et al. |
| 2007/0127977 | A1 | 6/2007 | Aiken |
| 2008/0317544 | A1 | 12/2008 | Spirk et al. |
| 2009/0263175 | A1 | 10/2009 | Groh et al. |
| 2011/0142530 | A1 | 6/2011 | Myers |
| 2011/0259359 | A1 | 10/2011 | Groh et al. |
| 2012/0124758 | A1 | 5/2012 | Sabisch et al. |
| 2012/0207531 | A1 | 8/2012 | Rusev |
| 2012/0234336 | A1 | 9/2012 | Paquet et al. |
| 2012/0257920 | A1 | 10/2012 | Jimenez et al. |
| 2012/0282010 | A1 | 11/2012 | Albers |
| 2013/0118515 | A1 | 5/2013 | Wurtz et al. |
| 2014/0064821 | A1 | 3/2014 | Price et al. |
| 2017/0238672 | A1 | 8/2017 | Moskovich |
| 2018/0027942 | A1 | 2/2018 | Jeon |
| 2018/0168314 | A1 | 6/2018 | Kulshreshtha |
| 2021/0045519 | A1 | 2/2021 | Chen |
| 2022/0061488 | A1 | 3/2022 | Bickford et al. |
| 2022/0110442 | A1 | 4/2022 | Cardwell et al. |
| 2022/0183455 | A1* | 6/2022 | Ji ..... A46B 15/0081 |
| 2022/0232946 | A1 | 7/2022 | Cui |
| 2024/0023695 | A1 | 1/2024 | Staudt |

FOREIGN PATENT DOCUMENTS

| | | | |
|---|---|---|---|
| CN | 304876919 | S | 11/2018 |
| CN | 304889579 | S | 11/2018 |
| CN | 304959842 | S | 12/2018 |
| CN | 305156732 | S | 5/2019 |
| CN | 305647253 | S | 3/2020 |
| CN | 306640729 | S | 6/2021 |
| CN | 307131259 | S | 2/2022 |
| CN | 307419511 | S | 6/2022 |
| CN | 307438769 | S | 7/2022 |
| DE | 3319462 | A1 | 11/1984 |
| DE | 3831571 | A1 | 3/1990 |
| DE | 4003526 | A1 | 8/1991 |
| DE | 20011640 | U1 | 10/2000 |
| DE | 10306983 | A1 | 9/2003 |
| EP | 0126905 | A2 | 12/1984 |
| FR | 748244 | A | 6/1933 |
| FR | 1068906 | A | 7/1954 |
| FR | 2592562 | A1 | 7/1987 |
| FR | 2855948 | A1 | 12/2004 |
| FR | 2894117 | A1 | 6/2007 |
| FR | 3078236 | A1 | 8/2019 |
| GB | 2144978 | A | 3/1985 |

(56) References Cited

FOREIGN PATENT DOCUMENTS

| | | | |
|---|---|---|---|
| GB | 2322797 | A | 9/1998 |
| GB | 0113310 | A | 7/2001 |
| GB | 2363062 | A | 12/2001 |
| GB | 2377367 | A | 1/2003 |
| GB | 0905660 | A | 5/2009 |
| GB | 2469095 | A | 10/2010 |
| JP | D1753954 | | 9/2023 |
| WO | 8404658 | A1 | 12/1984 |
| WO | D091038-0007 | | 9/2016 |

OTHER PUBLICATIONS

PCT Search Report and Written Opinion for PCT/US2023/070104, dated Oct. 12, 2023, 12 pages.
All Office Actions; U.S. Appl. No. 18/357,317, filed Jul. 24, 2023.
All Office Actions; U.S. Appl. No. 29/847,255, filed Jul. 22, 2022.
All Office Actions; U.S. Appl. No. 29/973,194, filed Nov. 14, 2024.
Gillette Venus Mini Facial Hair Remover, Amazon, Online Retrieved from: https://www.amazon.com/Gillette-Venus-Remover-Portable-Electric/dp/B0BJ17FS7C/ref=cm_cr_arp_d_product_top?ie=UTF8, Jan. 22, 2024, 6 Pages.

* cited by examiner

PERSONAL CARE PRODUCT DISPENSING SYSTEM

FIELD OF THE INVENTION

The present invention relates to personal care articles and more particularly to a dispensing system for a spreadable material.

BACKGROUND OF THE INVENTION

It is generally known that applying a shaving lotion (e.g., shaving oil or cream) prior to shaving aids in hydrating the hair and lubricating the surface of the skin, which aids in reducing nicks, cuts and irritation. It is also generally known that applying a shaving lotion (e.g., aftershave balm or moisturizer) helps moisturize the skin and sooth shaving irritation. Liquid personal care products are available in a wide variety of packages, including bottles, jars, tubes, and cans. Liquid personal care products meant for application to the skin are traditionally dispensed from a container onto users' hands and then applied to the skin by hand. Examples of such products include lotion, facial cleanser, and shaving cream. This application method however can be messy, and that portion of the product that does not get transferred from users' fingers is wasted.

It is generally known that personal care articles can incorporate a mechanical device that works in collaboration with a chemical composition. Examples may include, but are not limited to shaving brushes, wet shaving razors, electric razors and toothbrushes. However, these devices have not been optimized for the application of a shaving aid to the skin. For example, many dispensing systems rely on aerosol technologies which typically use blowing agents or other pressurized gases, or metered pump systems, which are not very sustainable. In addition, conventional brush dispenser devices typically use valves which can require multiple parts and be costly and complex to assemble.

Few liquid personal care products on the market have applicators or lathering aids. While patents relating to brush attachments for shaving cream in traditional aerosol cans do exist, there are no well-known lathering aids for shaving cream currently available for consumer purchase. Numerous aerosol shaving cream containers with a shaving brush attachment have been proposed in the patent literature. Despite these and other attempts, there remains a need for a new package for dispensing a personal care product which provides suitable product dispersal into and/or onto the applicator surface, but is also easy to clean.

SUMMARY OF THE INVENTION

In one aspect, the invention features, in general a personal care product dispensing system with a body defining a cavity configured to retain a spreadable personal care composition. A spreadable material positioned within the cavity. A movable platform positioned within the body and supporting the spreadable material. An actuator mechanism engaged with the movable platform. A cover mounted to the body. The cover defining a first aperture extending from a top surface of the cover to a bottom surface of the cover. A flexible applicator pad mounted to the top surface of the cover with a valve positioned over the first aperture. The flexible applicator pad has a plurality of projections comprising a material having a Shore A durometer of 30 to 70 and the projections have a maximum cross sectional area of 0.20 $mm^2$ to 0.60 $mm^2$.

In another aspect, the invention features, in general a personal care product dispensing system having a body defining a cavity configured to retain a spreadable personal care product. A spreadable material is positioned within the cavity. A cover is mounted to the body. The cover defines a first aperture extending from a top surface of the cover to a bottom surface of the cover. A flexible applicator pad is mounted to the top surface of the cover with a valve positioned over the first aperture. The flexible applicator pad has a plurality of projections and a projection density of 10 to 40 projections per square centimeter.

In another aspect, the invention features, in a method of manufacturing a personal care product dispensing system by providing a body having a movable platform. The movable platform is engaged with an actuator mechanism. A cavity defined by the body is filled with a spreadable personal care product. A cover defining a first aperture extending from a top surface of the cover to a bottom surface of the cover is injection molded. A flexible applicator pad having a plurality of projections is injection molded over the first aperture and the top surface of the cover. The flexible applicator pad is slit at the first aperture of the cover to form a valve. The cover is mounted to the body.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
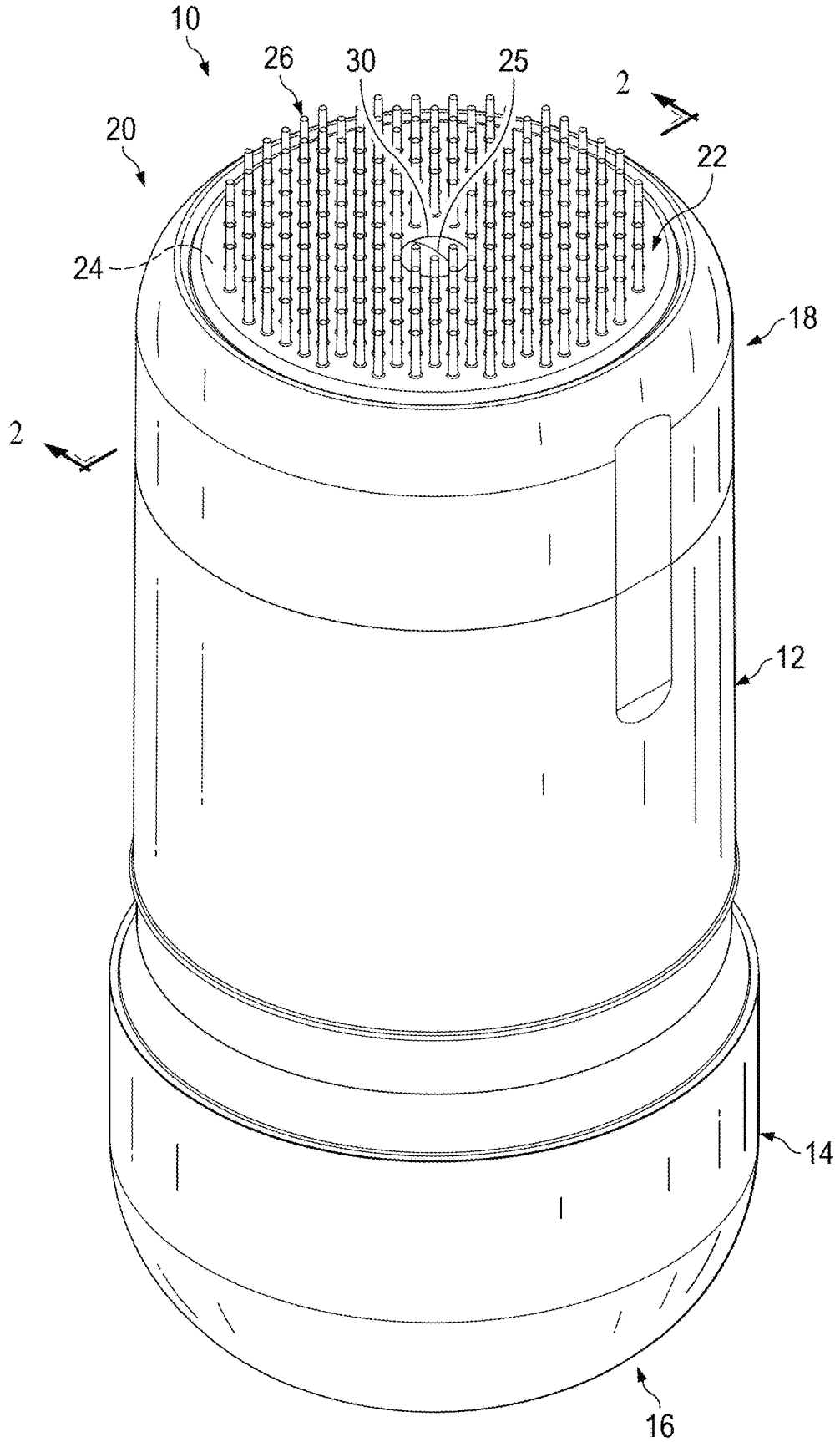
FIG. 1 is a front perspective view of a personal care product dispensing system according to one possible embodiment of the present invention.

Referring to FIG. 1, a front perspective view is shown of a personal care product dispensing system 10. It is understood that the personal care product dispensing system 10 illustrated may be used for applying a shaving aid or other personal care product to the surface of the skin. The personal care product dispensing system 10 may include a body 12 having an actuator 14 at a first end 16 of the body. The body 12 may be manufactured from a generally rigid material, such as metal (e.g., aluminum or stainless steel) or a thermoplastic. In certain embodiments, the body 12 may be injection molded from a thermoplastic having a Shore A hardness of about 50, 60 or 70 to about 90, 110, or 120. For example, high impact polystyrene (HIPS), polyethylene terephthalate (PET), polypropylene (PP), polyethylene (PE), acrylonitrile butadiene styrene (ABS), polycarbonate (PC), and combinations thereof may be used. As will be explained in greater detail below, the actuator 14 may be rotated relative to the body 12 to dispense a spreadable material contained within the body 12.

A cover 18 may be mounted to a second end 20 of the body 12, opposite the first end 16. In certain embodiments, the cover 18 may be manufactured from the same material as the body 12. The cover 18 may be secured to the body 12 by snap fitting, press fitting, welding (ultra-sonic welding, spin-welding), adhesives, mechanical fasteners or other commonly known assembly techniques. A flexible applicator pad 22 may be mounted to a top surface 24 of the cover 18. In certain embodiments the flexible applicator pad 22 may be co-injection molded or insert molded to the cover 18. The flexible applicator pad 22 may comprise a material that is a softer material than the material of the cover 18 (i.e., lower Shore A durometer hardness). For example, the flexible applicator pad 22 may have a Shore A hardness of about 20, 30, or 40 to about 50, 60, or 70. The flexible applicator pad 22 may be manufactured from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, the flexible applicator pad 22 may comprise Kraiburg HTC 1028/96, HTC 8802/37, HTC 8802/34, or HTC 8802/11 (KRAIBURG TPE GmbH & Co. KG of Waldkraiburg, Germany). The softer material of the flexible applicator pad 22 may enhance skin stretching, as well as provide a more pleasant tactile feel against the skin of the user during shaving.

A TPE material may be preferred for the flexible applicator pad 22. A TPE may be preferred versus silicone, for example, for recyclability purposes. The applicator pad 22 may comprise one or more thermoplastic elastomers (TPE) selected from the group of styrene block copolymers (TPS), thermoplastic polyolefin elastomers (TPO), thermoplastic elastomer vulcanizates (TPV), thermoplastic polyurethane elastomers (TPU), thermoplastic co-polyester elastomers (TPC), thermoplastic polyamide elastomers (TPA), non-classified thermoplastic clastomers (TPZ), and combinations thereof. To aid with recyclability of the container, the applicator pad 22 may include at least one of a non-cross-linked material and a melt-processible material or the flexible applicator pad 22 may be made entirely from one or more non-cross-linked, melt-processible materials. Without being bound by theory, it is believed that cross-linked elastomeric materials will pass through the recycling process and appear in the finished recycled material as specks which may make the recycled material unacceptable for many uses.

Separately, the flexible applicator pad 22 may be made from a material that has a density that would allow it to be float-separable from the material comprising the body 12 of the dispensing system 10. For example, if the body 12 of the dispensing system we made from polyethylene terephthalate (PET) which has a higher density than water and therefore would sink in a float-separation recycling process, the flexible applicator pad 22 may have a density less than 1.0 g/ml. Similarly, if the body 12 were made from polyethylene or polypropylene (PE or PP) which have densities that are less than water, the flexible applicator pad 22 may have a density greater than 1.0 g/ml.

The density of the material comprising the flexible applicator pad 22 may be adjusted through the use of additives. For example the density of the applicator pad 22 may be reduced by foaming the material, thereby adding air. The density of the applicator pad 22 may be increased by adding relatively dense particulates such as TiO2, or other solids.

Separately, the flexible applicator pad 22 may comprise less than 1-% or less than 5% or even less than 1% of the total empty weight of the personal care product dispensing system 10 (not including any personal care composition that is applied to the skin) as many current recycling processes sort the material to be recycled on the basis of their primary components and require that these primary components comprise greater than 90% or 95% or even 99% of the material being recycled.

In certain embodiments, the material of the flexible applicator pad 22 may also comprise a material containing a built-in active ingredient that makes the flexible applicator pad 22 resistant to microbial growth, such as bacteria, mold, and mildew. The most common additives used to manufacture antimicrobial plastics include various isothiazolinone treatments, zinc pyrithione, thiabendazole, and silver antimicrobial products.

The flexible applicator pad 22 may have a plurality of spaced apart projections 26 extending generally perpendicular to and extending from a top surface 28 of the flexible applicator pad 22. The flexible applicator pad 22 and the spaced apart projections 26 may be an integral component formed from the same material. As will be described in greater detail below, the spacing and dimensions of the projections 26 may facilitate easy application of a spreadable material (e.g., shaving aid) to the surface of the skin, as well as improve cleaning and rinsing of the applicator pad 22 after use. The flexible applicator pad 22 may include a valve 30 to help prevent ingress of water into the body 12 during rinsing and/or prevent unintentional dispensing of spreadable material. In certain embodiments, the valve 30 may include a slit 25 in the flexible applicator pad 22. The slit 25 may be straight, curved or angled. The slit 25 may also include multiple slits, to form "X", "V", or "Y" shapes. Other valves may also be used, such as a duck bill valve. Although only a single valve 30 is shown, multiple valves 30 may be used depending on the properties of the spreadable material and the quantity needed to be dispensed. The valve 30 may be positioned toward a center of the flexible applicator pad 22, but other locations are possible, especially if multiple valves are used.

Figure 2:
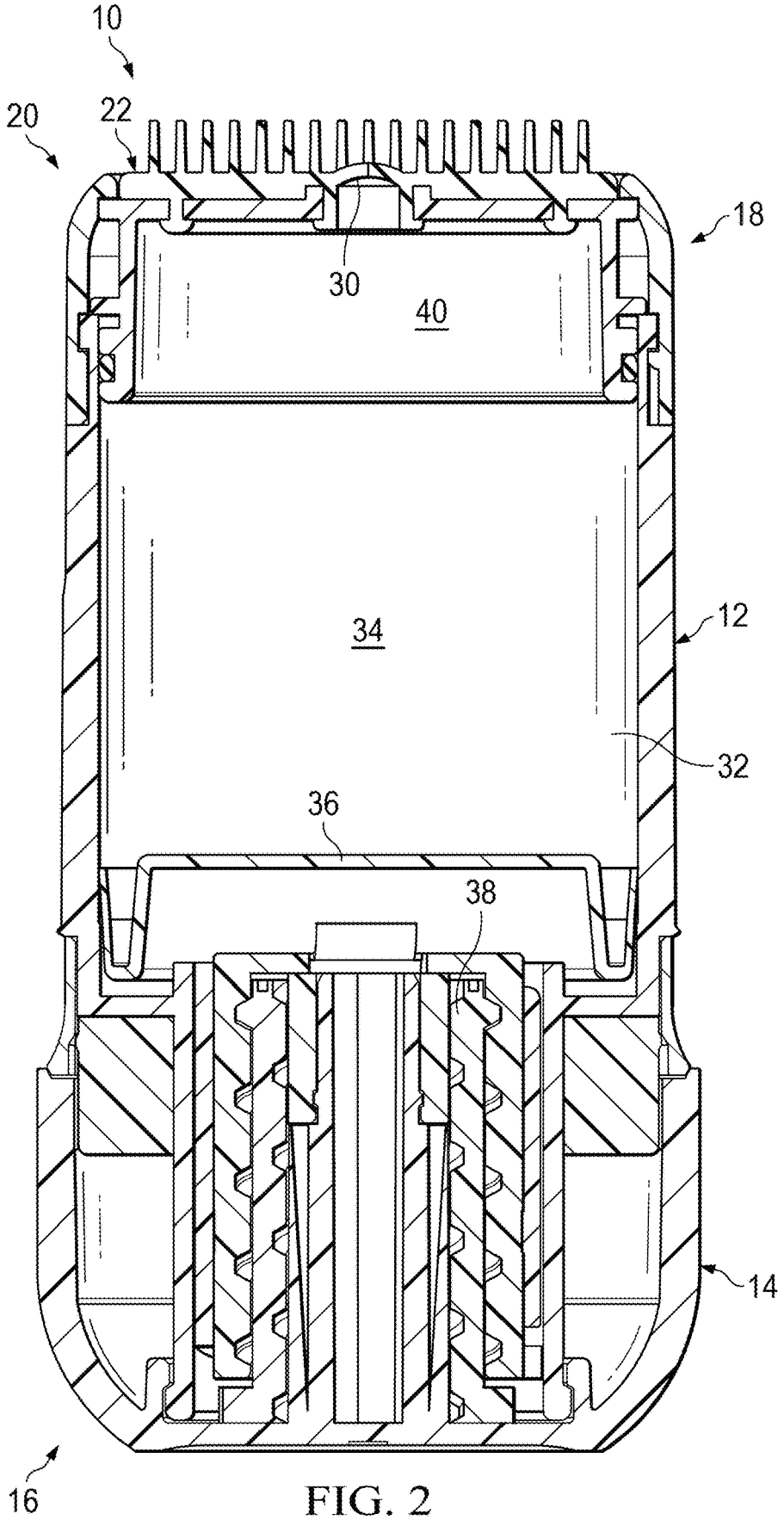
FIG. 2 is a cross sectional view of the personal care product dispensing system, taken generally along the line 2-2 of FIG. 1.

Referring to FIG. 2, a cross sectional view of the personal care product dispensing system 10 is shown, taken generally along the line 2-2 of FIG. 1. The body 12 of the personal care product dispensing system 10 may define a cavity 32 configured to contain a spreadable personal care composition 34, such as a shaving aid that may be applied to the skin prior to shaving (i.e. for providing lubrication during shaving and/or moisturization). The spreadable personal care composition 34 may include gels, oils, pastes, waxes and/or viscous liquids.

The spreadable personal care composition 34 may be supported by a movable platform 36. An actuator mechanism 38, such as a threaded elevator, may engage the platform 36. Accordingly, the actuator 14 may be rotated, causing the actuator mechanism 38 to move the platform 36 in an upward direction (i.e. towards the second end 20) relative to the body 12 to force the spreadable personal care composition 34 into a cavity 40 defined by the cover 18 and through the valve 30 of the flexible applicator pad 22. The cavity 40 of the cover 18 may be in communication with the cavity 32 of the body 12. In certain embodiments, the cavity 32 defined by the body 12 may contain the spreadable personal care composition 34. The spreadable personal care composition may be poured, sprayed, injected or simply dropped (e.g., as a solid form) into the cavity 32. The cover 18 may then be mounted over the body 12. Thus, the cavity 40 defined by the cover 18 may create additional head space. Accordingly, the platform 36 may need to be raised more for the first initial use for the spreadable personal care composition 34 to reach and exit the valve 30. Although a screw-type actuator mechanism 38 is shown, it is understood that the cover 18 and the flexible applicator pad 22 may be used with other dispensing mechanisms, such as push-up pistons, squeeze bottles and the like.

Figure 3:
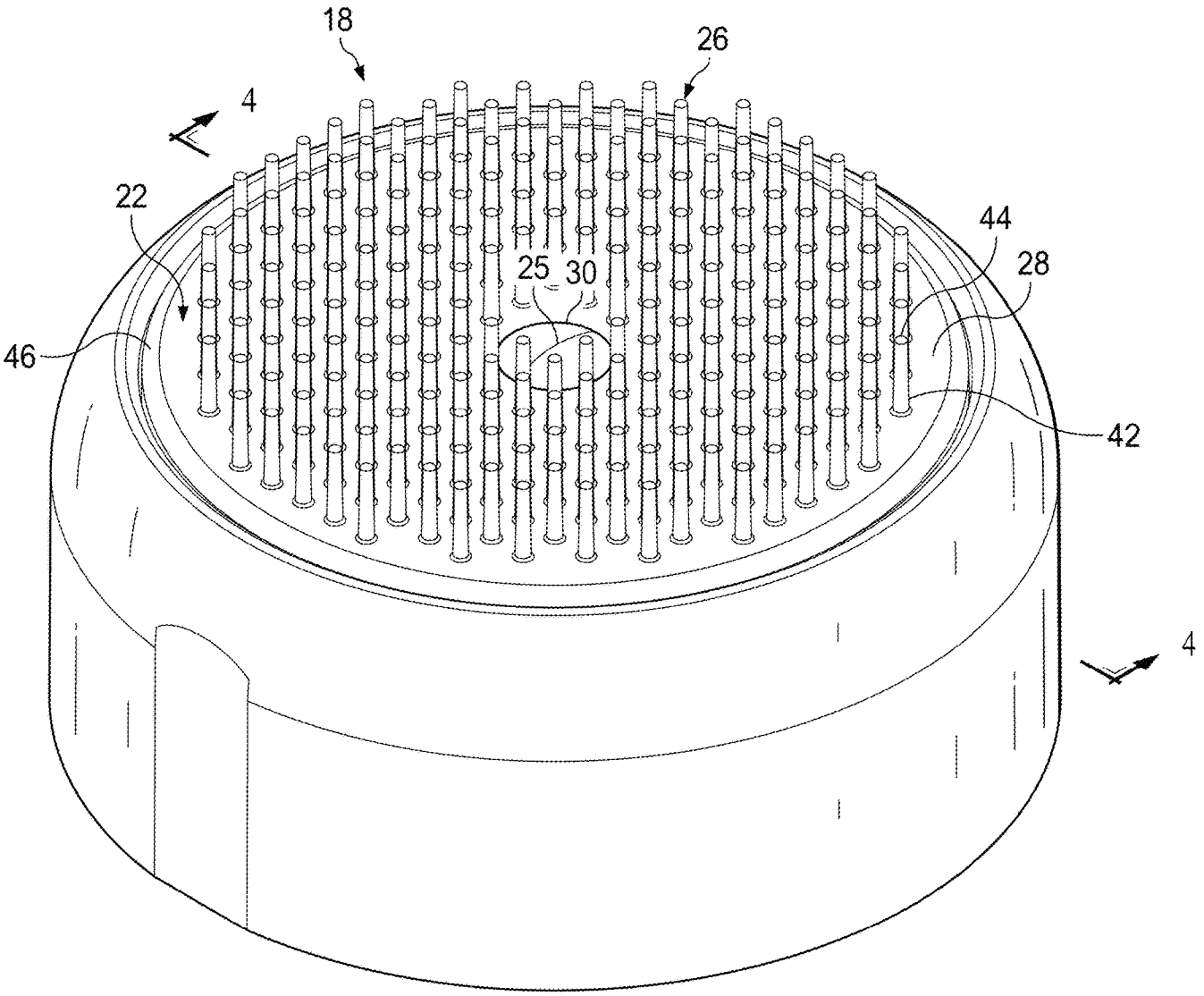
FIG. 3 is front perspective view of a cover and a flexible applicator pad of the personal care product dispensing system of FIG. 1.

Referring to FIG. 3, a front perspective view of the cover 18 is shown. The flexible applicator pad 22 (i.e. not including the projections, 26) may have a surface area of about 5 $cm^2$ to about 20 $cm^2$ and more preferably about 10 $cm^2$ to about 15 $cm^2$. The projections 26 may be conical, frusto-conical, or cylindrical in shape with a substantially circular cross section. However, other cross-sections are also anticipated, such as ellipses, ovals, triangles, squares, diamonds, or D-shaped configurations. The projections 26 may be solid or hollow. A solid configuration may be preferred for the projections 26 for improved cleaning of the projections 26. Each of the projections 26 may have a maximum cross sectional area of about 0.20 $mm^2$ to about 0.60 $mm^2$ and more preferably about 0.40 $mm^2$ to about 0.50 $mm^2$. The projections 26 may extend from the top surface 28 of the flexible applicator pad 22 to a tip 44 of the respective projection 26. The projections 26 may be tapered from a base 42 at the top surface 28 of the flexible applicator pad 22 to a respective tip 44 of the projection. Accordingly, the maximum cross sectional area may be located at the base 42. However, the projections 26 may include enlarged portions, such as a head (not shown) at the tip 44. Accordingly, in certain embodiments, the maximum cross sectional area may not necessarily always be at the base 42 of the projection 26.

In certain embodiments, the flexible applicator pad 22 may have a projection density of about 10 to about 40 projections 26 per square centimeter and more preferably about 15 to about 25 projections 26 per square centimeter. The projection density may be calculated by dividing the total number of the projections 26 by the surface area of the flexible applicator pad 22. The projection density may be taken over any area of the flexible applicator pad 22. For example, the area of the flexible applicator pad 22 used or the calculation of the projection density may be a portion of the total area of the flexible applicator pad 22 or over the entire surface of the applicator pad 22 may be taken as the average projection density.

The projection density may be constant over the entire surface of the applicator pad 22 or may vary over the surface. For example, the projection density may be lower in the vicinity of the valve 30 than the average projection density. Alternately, the projection density may be higher than the average projection density at the periphery of the applicator pad, or higher than the average projection density in a region that is intermediate the valve and the periphery.

Figure 4:
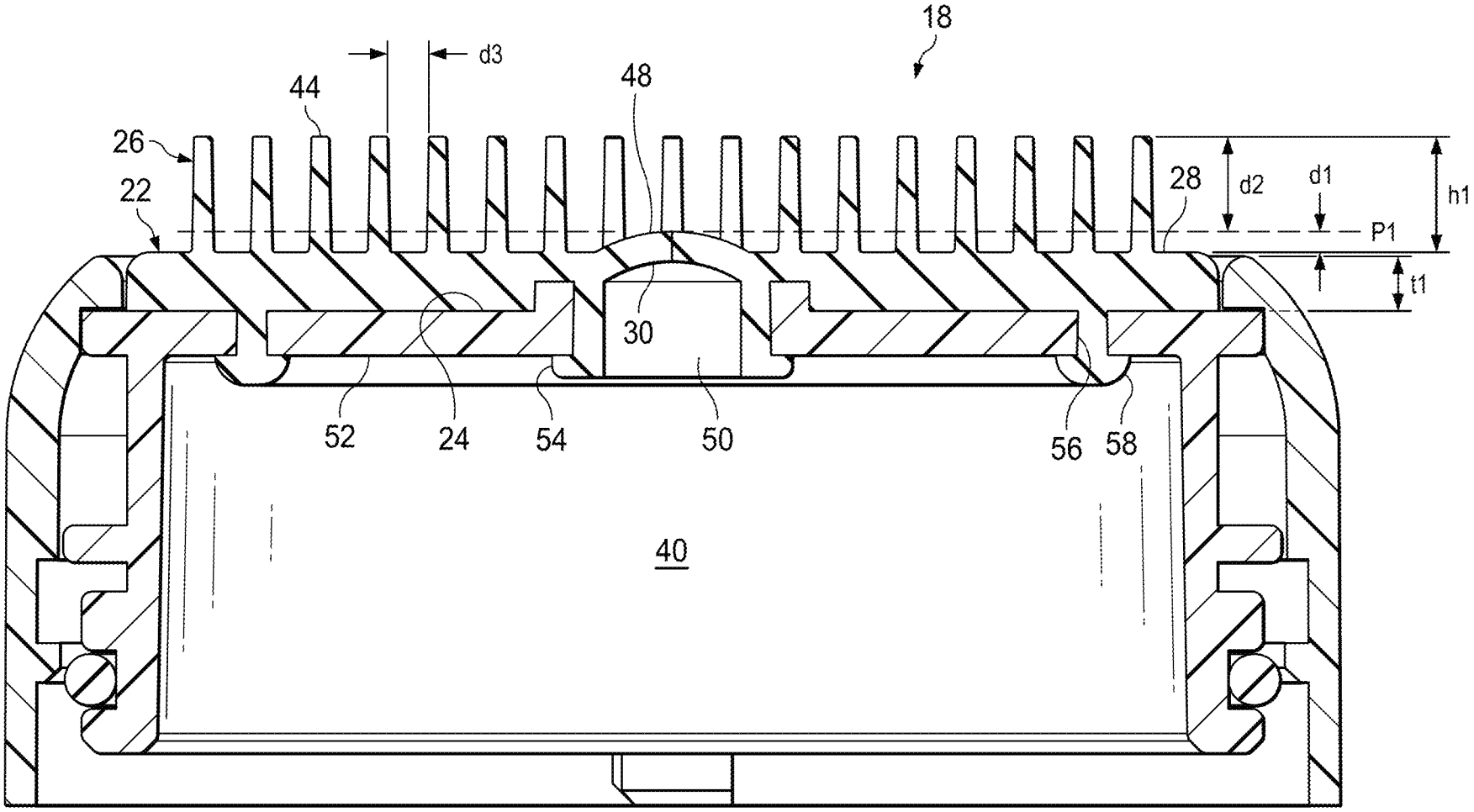
FIG. 4 is a front cross sectional view of the cover and the flexible applicator pad, taken generally along the line 4-4 of FIG. 3.

Referring to FIG. 4, a cross section of the cover 18 is illustrated. The projections 26 may extend from the top surface 28 of the flexible applicator pad 22. The projections 26 may have a height "h1" from the top surface 28 of the flexible applicator pad 22 to the tips 44 of about 2.0 mm to about 8.0 mm and more preferably about 3.0 mm to about 5.0 mm. The height of the projections 26 may facilitate the lathering of the spreadable personal care composition 34 against the surface of a user's skin. The height of the projections may also massage the user's skin and facilitate exfoliation of the skin and alignment of the hairs in a more upright position for trimming and/or shaving. The combination of the height, maximum cross sectional area and the durometer of the material of the projections 26 (and the flexible applicator pad 22) may include, but not limited to facilitating the distribution of the spreadable personal care composition 34 more evenly, exfoliating the skin, facilitating the release of trapped hairs and facilitating the removing of dirt, debris and dead skin. In addition, the combination of the height, the maximum cross sectional area and the durometer of the material of the projections 26 (and the flexible applicator pad 22) may improve the cleaning and rinsing of the flexible applicator pad 22 after use.

In certain embodiments, the valve 30 may have a top surface 48 that is dome-shaped. The dome shape may help prevent the valve 30 from collapsing in on itself, thus reducing leakage. The top surface 48 of the valve 30 may extend above the top surface 28 of the flexible applicator pad 22. For example, the top surface 48 of the valve 30 may be positioned on a plane "P1" that is a distance "d1" of about 0.7 mm to about 1.5 mm above the top surface 28 of the flexible applicator pad 22 and a distance "d2" of about 2.0 mm to about 5.0 mm below the tips 44 of the projections 26. The position of the valve 30 relative to the top surface 28 may minimize deflection of the valve 30 during use which may pinch the valve 30. For example, if the valve 30 is pinched, then the valve 30 may be blocked or unable to open and deliver the spreadable personal care composition 34 to the user's skin during application. The position of the valve 30 relative to the tips 44 of the projections 44 may facilitate delivering a sufficient amount of the spreadable personal care composition 34 (FIG. 3) to the skin during use. For example, if the valve 30 was positioned too far below the tips 44, the spreadable personal care composition 34 may become trapped between the projections 26 and not delivered to the user's skin during application, which may require more spreadable personal care composition 34 to be used. In certain embodiments, the projections 26 may be spaced apart from each other by a minimal distance "d3" of about 1.0 mm to about 3.0 mm. The spacing of the projections 26 may provide room for the projections 26 to deflect during use, as well as provide sufficient room for rinsing and cleaning the top surface 28 and the projections 26 of the flexible applicator pad 22. The flexible applicator pad 22 may have a thickness "t1" of about 1.5 mm to 3.0 mm. The thickness "t1" may be measured from the top surface 24 of the cover 18 to the top surface 28 of the flexible applicator pad 22. If the thickness "t1" is too small, the projections 26 may break off from the flexible applicator pad 22. However, if the thickness "t1" is too large, the feel of the flexible applicator pad 22 against a user's skin may not feel as comfortable.

Figure 5:
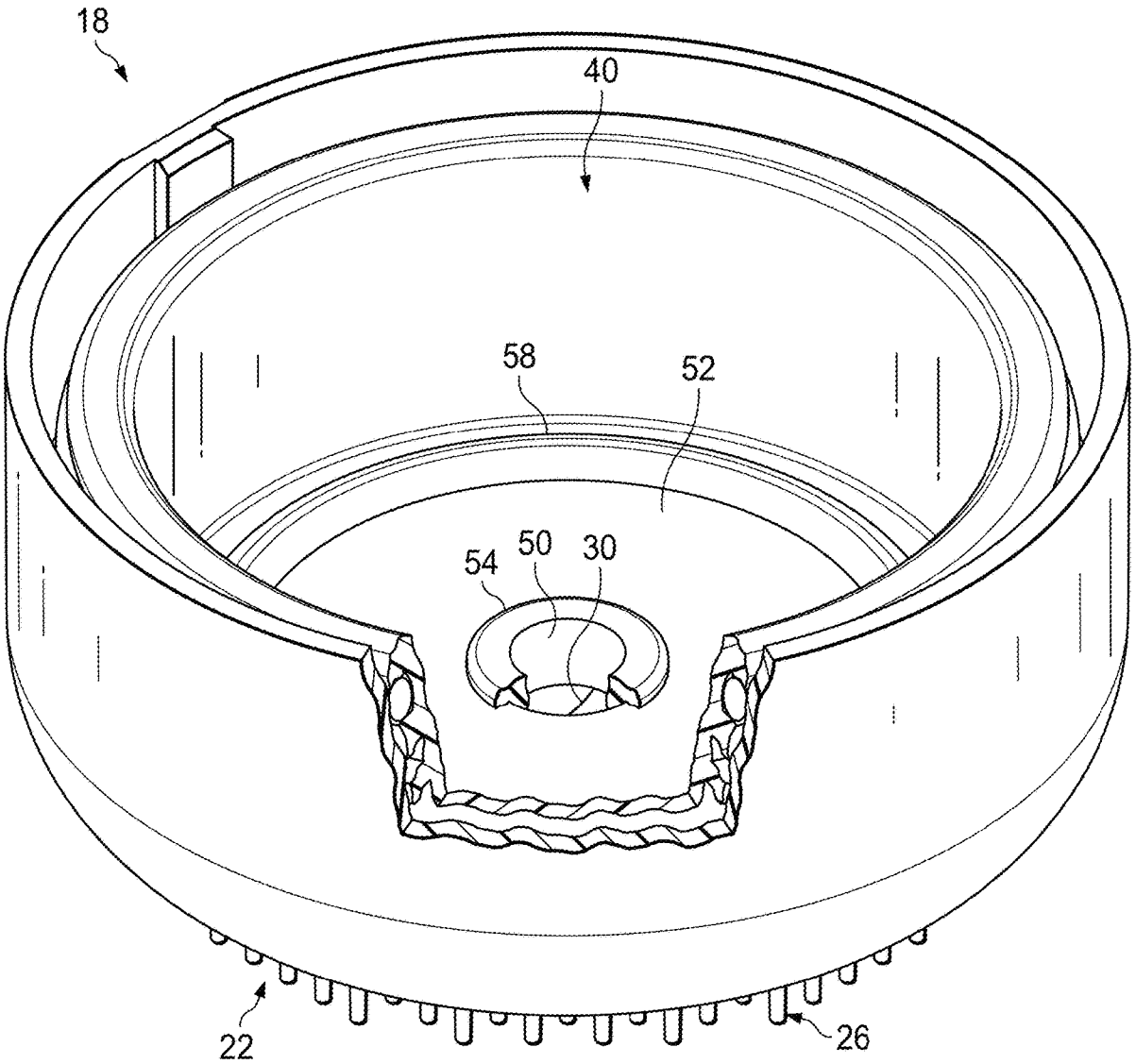
FIG. 5 is a bottom perspective view of the personal care product dispensing system.

Now with additional reference to FIG. 5, attachment of the flexible applicator pad 22 to the cover 18 will be described in greater detail. FIG. 5 illustrates a bottom view of the flexible applicator pad 22 secured to the cover 18. The cover 18 may be manufactured from a generally rigid material, such as metal (e.g., aluminum or stainless steel) or a thermoplastic such as, high impact polystyrene (HIPS), polyethylene terephthalate (PET), polypropylene (PP), polyethylene (PE), acrylonitrile butadiene styrene (ABS), polycarbonate (PC), and combinations thereof. The cover 18 may be made from the same material as the body 12. Accordingly, the cover 18 may support the flexible applicator pad 22. The cover 18 may define a first aperture 50 that is in communication with the cavity 40. The first aperture may have a diameter of 3 mm to 7 mm. The first aperture 50 may extend through the cover 18 from the top surface 24 to a bottom surface 52 of the cover 18. The flexible applicator pad 22 may cover the top surface 24 of the cover 18 and extend over the first aperture 50. The flexible applicator pad 22 may also extend into the first aperture 50 and form a first ring 54 against the bottom surface 52 of the cover 18. The first ring 54 may help reinforce the valve 30 and facilitate securement of the flexible applicator pad 22 to the cover 18. The cover 18 may define a second aperture 56. A portion of the flexible applicator pad 22 may extend into the second aperture 56. For example, the flexible applicator pad 22 may extend into the second aperture 56 and form a second ring 58 against the bottom surface 52 of the cover 18. The second ring 58 may extend around the first ring 54 to facilitate securement of the flexible applicator pad 22 to the cover 18.

In certain embodiments, the personal care product dispensing system 10 of FIGS. 1 and 2 may be manufactured by providing the body 12 with the movable platform 36. The body 12 may be injection molded and the movable platform 36 may be inserted into the cavity 32 of the body 12. The actuator mechanism 38 may be mounted to the first end 16 of the body 12. The actuator mechanism 38 may be engaged with the movable platform 36 such that the actuator mechanism 38 causes the moveable platform 36 to slide within the cavity 32 toward the second end 20 of the body 12. The cavity 32 defined by the body 12 may be filled with the spreadable personal care composition 34 before or after the platform 36 is positioned within cavity 32. The cavity 32 may be filled with the spreadable personal care composition from either the top (i.e., end toward the flexible applicator pad 22 of FIG. 2) or the bottom (i.e., end toward the actuator 14 of FIG. 2).

The cover 18 may be injection molded from a first polymeric material. A second polymeric material, different than the first polymeric material (i.e. a TPE material), may be injection molded to the cover 18, thus forming the flexible applicator pad 22. The second polymeric material may flow into the first aperture 50 and the second aperture 56 forming the first ring 54 and the second ring 58, respectively. The second polymeric material may also completely cover the first aperture 50. The flexible applicator pad 22 may be slit at the first aperture 50 to form the valve 30. The cover 18 may be mounted to the second end 20 of the body 12 after forming the valve 30.

In certain embodiments, the cover 18 may be fixed to the body 12 so that the user can not readily remove the cover from the body. However, it is understood that the cover 18 may be temporarily secured to the body 12 thereby allowing the consumer to remove the cover 18 (or alternatively the actuator 14 of FIG. 2) and replace the spreadable personal care composition 34. For example, the cover 18 may have threads or J-lock features and the second end 20 of the body 12 may have corresponding engaging features that allow the cover 18 to be removed by the user. The user may move the platform down towards the first end 16 of the body 12. The user may then insert a replaceable spreadable personal care composition 34 on top of the platform 36 and reattach the cover 18 to the body 12. The replaceable spreadable personal care composition 34 may be refilled as a liquid directly into the cavity 32 or may be provided in a cartridge or other prefilled container that can be installed into the cavity 32.

EXAMPLES

The following example formulations of shaving aids in accordance with the present disclosure are made according to Tables 1-4 below. All values are w/w %.

It is believed, without being held to theory, that the compositions listed in Table 1 may provide for improved performance when used for clean shaving (i.e., cutting hair at or below the skin surface). These compositions may have more foaming and lathering properties when they are distributed against the skin with the flexible applicator pad 22, which may result in a closer and more comfortable shave. Furthermore, the compositions listed in Table 1 may provide for a more opaque appearance when applied to the user's skin, which may be desired for improved tracking.

TABLE 1

| | Example 1 | Example 2 | Example 3 | Example 4 | Example 5 |
|---|---|---|---|---|---|
| Water | 50.91% | 49.34% | 49.34% | 43.26% | 41.43% |
| Stearic Acid | 23.80% | 23.78% | 23.78% | 10.45% | 29.00% |
| Palmitic Acid | — | — | — | 12.87% | — |
| Myristic Acid | — | — | — | 11.23% | — |
| Petrolatum | — | 10.00% | — | — | — |
| Glycerin | 10.00% | — | 10.00% | 6.00% | 10.00% |
| Coconut Acid | 8.00% | 8.20% | 8.20% | 6.00% | 10.00% |
| Potassium Hydroxide | 4.68% | 4.98% | 4.98% | 7.00% | 6.50% |
| Triethanolamine | 1.20% | 1.28% | 1.28% | 1.50% | 1.50% |
| Shea Butter | — | 1.00% | — | — | — |
| Perfume | — | — | 1.00% | — | — |
| Phenoxyethanol | 0.78% | — | — | 0.90% | — |
| Benzyl Alcohol | — | 0.78% | 0.78% | — | 0.78% |
| Sodium Hydroxide | 0.48% | 0.50% | 0.50% | 0.50% | 0.60% |
| Hydroxypropyl Methylcellulose | 0.16% | 0.16% | 0.16% | 0.20% | 0.20% |
| Iodopropynyl Butylcarbamate | — | — | — | 0.09% | — |

It is believed, without being held to theory, that the compositions listed in Table 2 may provide for improved performance when used for trimming hair to a stubble length (i.e., not clean shaving). These compositions may have less foaming and lathering properties when they are distributed against the skin with the flexible applicator pad 22, thus facilitating the spread of the compositions through stubble length hair. Furthermore the compositions listed in Table 2 may provide for a less opaque appearance when applied to the user's skin, which may be desired for consumers to see where to trim or edge stubble length hair.

TABLE 2

| | Example 1 | Example 2 | Example 3 |
|---|---|---|---|
| Water | 70.20% | 81.96% | 93.72% |
| Sodium Laureth 2 Sulfate | 20.82% | 10.41% | — |
| Glycerin | 3.00% | 3.00% | 3.00% |
| Cocamidopropyl Betaine | 2.70% | 1.35% | — |
| Acrylates/C10-30 Alkyl Acrylate Crosspolymer* | 1.50% | 1.50% | 1.50% |
| Sodium Hydroxide | 0.78% | 0.78% | 0.78% |
| Sodium Benzoate | 0.45% | 0.45% | 0.45% |
| Sodium Salicylate | 0.45% | 0.45% | 0.45% |
| DiSodium EDTA | 0.10% | 0.10% | 0.10% |

*Under tradenames Carbopol Ultrez 20, Carbopol Ultrez 21, Pemulen TR-1, Pemulen TR-2 available from Lubrizol.

The compositions listed in Table 3 may include compositions for anti-perspirants and deodorants which may also be used for the spreadable personal care composition 34 within the personal care product dispensing system 10. The personal care product dispensing system 10 may apply and distribute the spreadable personal care composition 34 compared to typical anti-perspirants and deodorants containers that have a smooth application surface (e.g., no projections).

TABLE 3

| | Example 1 | Example 2 | Example 3 | Example 4 |
|---|---|---|---|---|
| Cyclomethicone | 33.75% | 64.45% | 67.25% | 62.25% |
| Aluminum zirconium trichlorohydrex gly | 26.00% | 26.00% | 26.00% | 26.00% |
| Butyl Stearate | 33.50% | 5.00% | — | 5.00% |
| Glyceryl Tribehenate | 5.00% | 3.25% | 5.00% | 5.00% |
| C18-C36 triglyceride | 1.25% | 0.80% | 1.25% | 1.25% |
| Perfume | 0.50% | 0.50% | 0.50% | 0.50% |

Specific chemistries of the spreadable personal care composition 34 listed in Tables 1-3 above may be preferred for certain dimensions and geometries of the projections 26. For example, a higher projection density and/or greater projection height may work better with the examples of Table 1 to create a richer lather when applied to the surface of the skin when mixed with water. Alternatively, lower projection density and/or lower projection height may work better with the examples of Table 2 when a clear application is desired (e.g., for cutting hair to a specific length to create a stubble beard appearance).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A personal care product dispensing system comprising:

a body defining a cavity configured to retain a spreadable personal care product;

a spreadable material positioned within the cavity;

a cover mounted to the body, the cover defining a first aperture extending from a top surface of the cover to a bottom surface of the cover; and a flexible applicator pad mounted to the top surface of the cover with a valve positioned over the first aperture, wherein the flexible applicator pad has a plurality of projections and each of the projections has a maximum cross sectional area of 0.20 $mm^2$ to 0.60 $mm^2$.

2. The personal care product dispensing system of claim 1 wherein the plurality of projections have a maximum cross sectional area of 0.40 $mm^2$ to about 0.50 $mm^2$ and the plurality of projections comprise a material having a Shore A durometer of 30 to 70.

3. The personal care product dispensing system of claim 1 wherein the valve is positioned on a plane below a tip of the projections.

4. The personal care product dispensing of claim 1 wherein the first aperture has a diameter of 3 mm to 7 mm.

5. The personal care product dispensing system of claim 1 wherein the projections each have a respective tip and the valve has a top surface that is positioned on a plane that is 2.0 mm to 5.0 mm below the tips of the projections.

6. The personal care product dispensing system a of claim 1 wherein the projections have a height extending from a top surface of the flexible applicator pad to a respective tip of the projections of 2.0 mm to 8.0 mm.

7. The personal care product dispensing system of claim 1 wherein the flexible applicator pad has a projection density of 15 to 25 projections per square centimeter.

8. The personal care product dispensing system of claim 1 wherein the cover defines a second aperture and a portion of the flexible applicator pad is positioned within the second aperture and forms a ring positioned against the bottom surface of the cover.

9. The personal care product dispensing system of claim 1 wherein the flexible applicator pad includes a ring that circumscribes the first aperture and is positioned against the bottom surface of the cover.

10. The personal care product dispensing system of claim 1 wherein the valve has a top surface that is dome shaped.

11. The personal care product dispensing system of claim 10 wherein the projections each have a respective tip and the top surface of the valve is positioned on a plane that is 2.0 mm to 5.0 mm below the tips of the projections.

12. The personal care product dispensing system of claim 1 wherein the flexible applicator pad has a thickness of 1.5 mm to 3.0 mm.

13. A method of manufacturing a personal care product dispensing system comprising:

providing a body having a movable platform;

engaging the movable platform with an actuator mechanism;

filling a cavity defined by the body with a spreadable personal care product;

injection molding a cover defining cavity and a first aperture extending from a top surface of the cover to a bottom surface of the cover;

injection molding a flexible applicator pad having a plurality of projections over the first aperture and the top surface of the cover;

slitting the flexible applicator pad at the first aperture of the cover to form a valve; and mounting the cover to the body.

14. The method of claim 13 further comprising securing the cover to the body.

15. The method of claim 14 wherein said securing comprises ultra-sonic welding.

16. The method of claim 13 further comprising moving the platform relative to the body to force the spreadable personal care composition into the cavity defined by the cover.

17. The method of claim 13 further comprising securing the flexible applicator pad to the cover by forming a ring that circumscribes the first aperture and is positioned against the bottom surface of the cover.

18. The method of claim 13 further comprising securing the flexible applicator pad to the cover by injection molding a portion of the flexible applicator pad into a second aperture of the cover.

19. The method of claim 13 wherein said injection molding includes molding a top surface of the applicator pad that is domed shaped and wherein said slitting is performed on the domed shaped top surface.

* * * * *